United States Patent [19]

Maheu

[11] Patent Number: 4,724,987

[45] Date of Patent: Feb. 16, 1988

[54] BABY CARRIER

[76] Inventor: Helen A. Maheu, P.O. Box 1195, Makawao, Hi. 96768

[21] Appl. No.: 869,590

[22] Filed: Jun. 2, 1986

[51] Int. Cl.[4] ..... A61G 1/00

[52] U.S. Cl. ..... 224/159; 224/157; 224/264

[58] Field of Search ..... 224/159, 160, 158, 264, 224/202, 253; 294/140; 150/107, 108

[56] References Cited

U.S. PATENT DOCUMENTS

| | | | |
|---|---|---|---|
| 1,273,201 | 7/1918 | Teuber | 224/264 X |
| 2,599,474 | 6/1952 | Mills | 224/160 |
| 2,808,973 | 10/1957 | Gobble | 224/264 |
| 4,139,131 | 2/1979 | Hathaway | 224/160 |
| 4,260,089 | 4/1981 | Daleo | 224/264 X |
| 4,431,041 | 2/1984 | Leiserson | 224/264 X |
| 4,436,233 | 3/1984 | Hill et al. | 224/159 |
| 4,550,869 | 11/1985 | Johnson | 224/264 X |
| 4,579,264 | 4/1986 | Napolitano | 224/160 |

FOREIGN PATENT DOCUMENTS

| | | | |
|---|---|---|---|
| 126761 | 2/1948 | Australia | 224/159 |

*Primary Examiner*—James E. Bryant, III
*Assistant Examiner*—Robert M. Petrik
*Attorney, Agent, or Firm*—Douglas L. Tschida

[57] ABSTRACT

An improved baby carrier having a contoured shoulder strap designed for distributing a baby's weight over the wearer's entire shoulder area. The shoulder strap includes two rings, one of which acts to attach the shoulder strap to the carrier and the other of which acts as a sliding lock to allow strap length adjustment without removal of the baby from the carrier.

4 Claims, 5 Drawing Figures

BABY CARRIER

BACKGROUND OF THE INVENTION

1. Field of the Invention

The invention relates to an improved design in baby carriers.

2. Description of the Prior Art

Baby carriers are designed to hold the baby to the wearer's body freeing the wearer's arms and hands. Other carriers have narrow shoulder straps, placing full weight of the baby on the edge of the wearer's trapezious muscles, causing tension in the neck and shoulders. Most baby cariers have no waistband to allieviate the full weight on the shoulder straps causing strain on lower back. This invention allows greater support, placing much of baby's weight on the hips and across full back and shoulders allowing for greater comfort and improved posture. Most baby carriers are not adjustable while holding baby's weight. The improved baby carrier allows for adjustment of shoulder strap to any variation without removal of baby from carrier.

SUMMARY OF THE INVENTION

The invention relates to an improved baby carrier which holds the baby to the wearer's body at the front or on either hip and distributes the weight of the baby to the best advantage of the wearer while giving support to a small baby and adjusting to give freedom of movement to a larger baby.

It is an object of the invention to provide a baby carrier with maximum advantage in weight distribution to the wearer, comfort to the baby, and ease of application, removal, and adjustment.

DESCRIPTION OF THE PREFERRED EMBODIMENT

Figure 1:
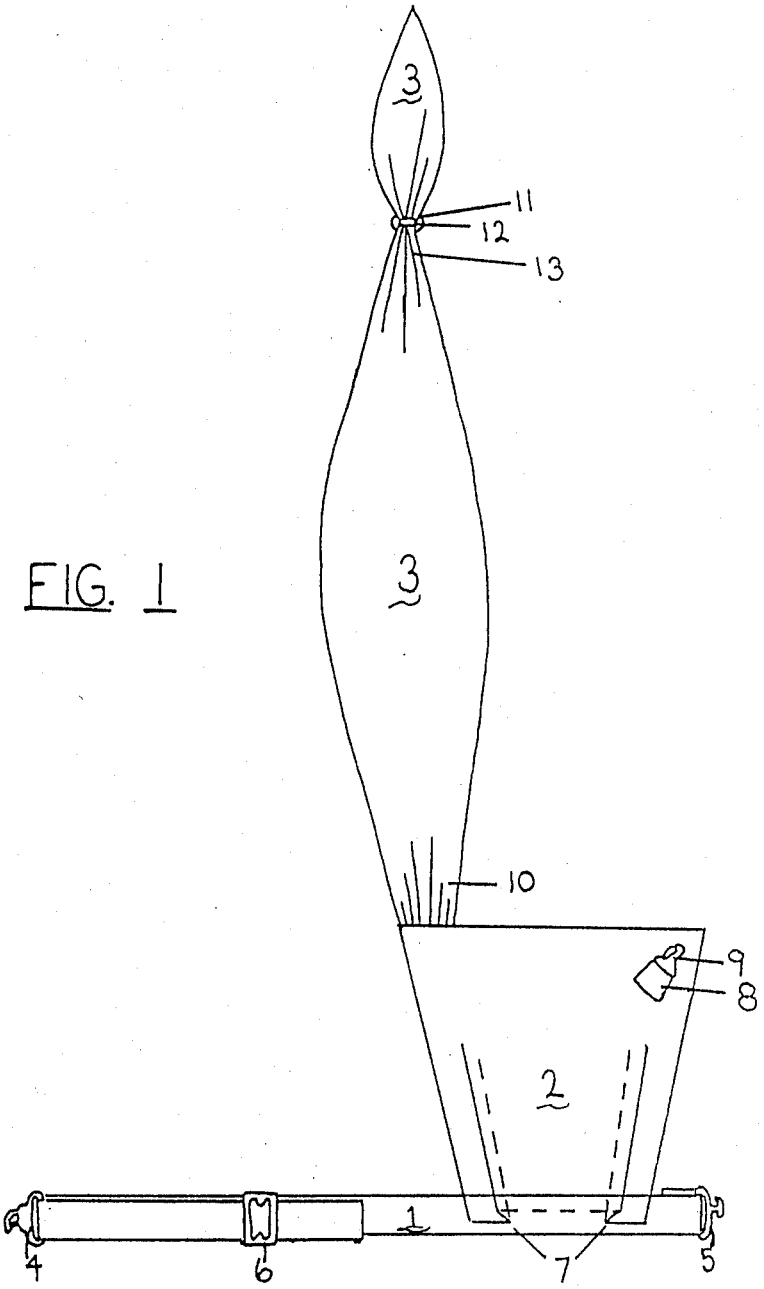
FIG. 1 is a flat front view showing the improved baby carrier.
Figure 2:
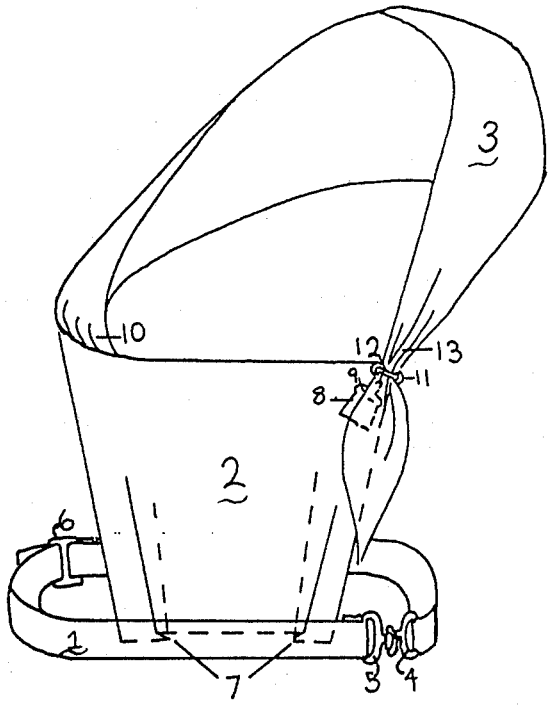
FIG. 2 is a front view showing position on wearer's body including wrap and closure of waist band and shoulder strap.
Figure 3:
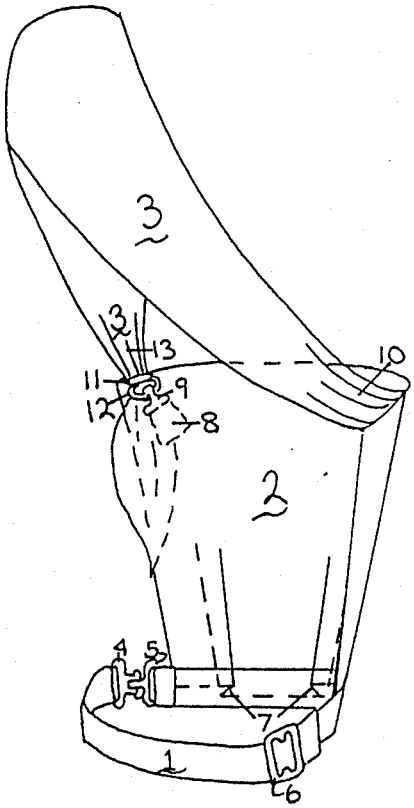
FIG. 3 is a back view showing wrap and closure of waist band and position of broad shoulder strap across full back and shoulder.

Referring to FIGS. 1,2 and 3, an embodiment of the baby carier is shown. In this embodiment waist band 1 is adjustable by sliding the band through a two inch bar slide 6. A two inch hook and eye sursingle 4 and 5 allows for an easy open and close process. The carrier seat 2 has two pleats 7 which open under baby's weight to create a contour fitted support to baby's bottom. A broad shoulder strap 3 which is attached to one side of the top of the seat 2 is pleated 10 down to approximately three inches where it is sewn to the carrier seat 2. This strap 3 which is gathered and looped through two 1 inch rings 11 and 12, then goes under one arm, across full back and over wearer's shoulder where it is secured to the opposite top corner of the seat 2 by clipping the ring 12 to the spring snap 9 which is secured to the carrier seat 2 by a tab of fabric 8.

Figure 4:
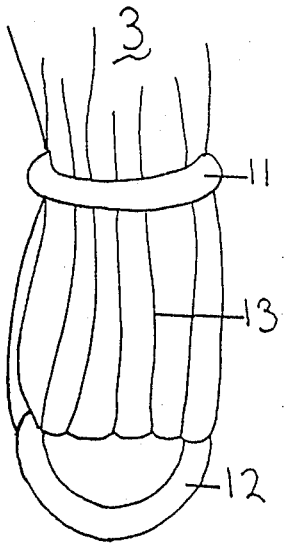
FIG. 4 is a view of gathered end of shoulder strap and rings in open position. Top ring raised allows freedom of movement of fabric for adjustment.
Figure 5:
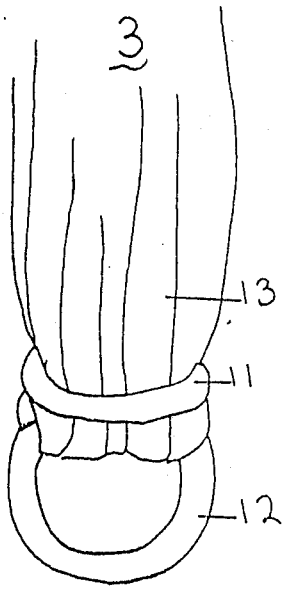
FIG. 5 is a view of gathered end of shoulder strap and rings showing locking position. Lowering of top ring insures no further movement of fabric.

Referring to FIGS. 4 and 5, fabric is gathered and put through the two rings 11 and 12. It is then brought back through the top ring 11 which is it's permanent position. This ring 11 may slide up or down releasing fabric for easy adjustment of any variation in shoulder strap 3 length.

I claim:

1. In a fabric infant carrier comprising a seat portion having top, bottom and side edges, wherein an infant is supported in straddled relation between the top edge of the seat and the wearer, and strap means for supporting the carrier from the wearer, the improvement comprising:

a. said strap means defined by a fabric strap cut along the material weft to a uniform width over its length wider than the wearer's shoulder and attached at one end in pleated relation to one corner of an upper edge of said seat and mountable over and about a wearer's shoulder and upper arm when supporting an infant on an opposite hip or in frontal relation to the wearer;

b. first and second circular ring members mounted about the other end of said strap such that said strap is gathered and passed through said first ring and said second ring is slidably mounted about the doubled over loop portion of said strap, whereby the relative length of said strap may be varied to suit the carrying position;

c. spring biased fastener means mounted to a fabric loop secured to the opposite corner of the upper edge of said seat and engageable with said first ring and situated such that said seat shields the fastener means and first ring from the infant in a region of said seat removed from the infant's face when said strap is trained about the wearer's shoulder and back ; and d. a length adjustable waist strap member mounted to a bottom edge of said seat and mountable about the wearer's waist.

2. In an infant carrier comprising a seat portion having top, bottom and side edges and strap means for supporting the carrier from the wearer, the improvement comprising:

a. said strap means defined by a strap of a width wider than the wearer's shoulder attached at one end in pleated relation to one corner of an upper edge of said seat and conformably mountable over and about a wearer's shoulder and upper arm when supporting an infant;

b. first and second circular ring members mounted about the other end of said strap such that said strap is gathered and passed through said first ring and said second ring is slidably mounted about the doubled over looped portion of said strap, whereby the relative length of said strap may be varied to suit the carrying position; and c. fastener means mounted to the opposite corner of the upper edge of said seat and engageable with said first ring and situated such that said seat shields the fastener means and first ring from the infant in a region of said seat removed from the infant's face when said strap is trained about the wearer's shoulder and back.

3. Apparatus as set forth in claim 2 wherein said fastener means comprises:

a. a fabric loop attached to said seat; and b. a clasp member mounted to said fabric loop having a spring biased locking portion which releasably snaps about said first ring.

4. Apparatus as set forth in claim 3 including a length adjustable second strap member mounted to a bottom edge of said seat and mountable about the wearer's waist.

* * * * *